US008491240B2

(12) United States Patent
Baker

(10) Patent No.: US 8,491,240 B2
(45) Date of Patent: Jul. 23, 2013

(54) MOBILE PALLET WITH LOCKING MECHANISM FOR A CONTAINER

(75) Inventor: Maurice Baker, Riddells Creek (AU)

(73) Assignee: Maurice Baker Pty Ltd, Riddells Creek, Victoria (AU)

( * ) Notice: Subject to any disclaimer, the term of this patent is extended or adjusted under 35 U.S.C. 154(b) by 0 days.

(21) Appl. No.: 13/203,345

(22) PCT Filed: Aug. 4, 2010

(86) PCT No.: PCT/AU2010/000985
§ 371 (c)(1),
(2), (4) Date: Oct. 10, 2011

(87) PCT Pub. No.: WO2011/014917
PCT Pub. Date: Feb. 10, 2011

(65) Prior Publication Data

US 2012/0039684 A1 Feb. 16, 2012

(30) Foreign Application Priority Data

Aug. 4, 2009 (AU) ..... 2009903639

(51) Int. Cl.
*B60P 3/00* (2006.01)

(52) U.S. Cl.
USPC ..... 410/66

(58) Field of Classification Search
USPC ..... 410/66
See application file for complete search history.

(56) References Cited

U.S. PATENT DOCUMENTS 3,456,826 A 7/1969 Pavlik
3,938,678 A 2/1976 Kern
7,517,180 B2 4/2009 Baker

*Primary Examiner* — H Gutman
(74) *Attorney, Agent, or Firm* — The Webb Law Firm

(57) ABSTRACT

A mobile pallet for loading into a container, the pallet comprising: a pallet chassis defining a leading end, a rear end and opposite sides of the pallet; wheels supporting the chassis for mobility; and at least one locking mechanism on one side of the pallet capable of extending outwardly of the pallet and locating against an adjacent inner side wall of the container to create a wedge between the pallet and the side wall thereby locking the pallet in the container.

13 Claims, 8 Drawing Sheets

MOBILE PALLET WITH LOCKING MECHANISM FOR A CONTAINER

The present invention relates to a mobile pallet of the kind that can be loaded and unloaded into a container, such as a freight container transportable by land, air or sea.

BACKGROUND OF INVENTION

Pallets are commonplace in the freight industry as they are a convenient means for supporting and transporting goods. Pallets can be in the form of simple frames for supporting loaded goods. These simple frame pallets require fork lifts or other machinery to load and unload the pallets from containers. Other forms of pallets have their own means for mobility in the form of wheels and hence can be rolled and more conveniently loaded and unloaded from containers.

Once loaded in the container the container doors are closed and the container can be freighted by road, rail, air or sea. Due to the sheer number of containers manufactured by different manufacturers there will inevitably be variations in container size including variations in the floor area inside a container. Consequently, while some pallets may fit tightly in one container and are therefore restrained against movement, the same pallets in other containers may have substantial gaps between the pallet edges and container walls. Such gaps cause problems with longitudinal and lateral movement of pallets within the container during transportation which can result in damage to the load being transported. Furthermore, pallets, which are usually manually loaded into the containers, are often not centred exactly on the container floor with equal spacing on either side but may be closer to one side wall more than the other which makes it more difficult to restrain the pallet inside the container.

The present mobile pallet provides a pallet that can be easily loaded and unloaded from a container and that can compensate for variations in size between containers to restrain the pallet within a container.

SUMMARY OF INVENTION

In accordance with the present invention there is provided a mobile pallet for loading into a container, the pallet comprising:

- a pallet chassis defining a leading end, a rear end and opposite sides of the pallet;
- wheels supporting the chassis for mobility; and
- at least one locking mechanism on one side of the pallet capable of extending outwardly of the pallet and locating against an adjacent inner side wall of the container to create a wedge between the pallet and the side wall thereby locking the pallet in the container.

In one embodiment the locking mechanism includes an outwardly extending member that locates against a side wall of the container to wedge the pallet within the container. If the pallet moves in the outward/rearward direction of the container, the wedge becomes stronger.

In one embodiment there are two locking mechanisms, one on each side of the pallet. The locking mechanisms on each side of the pallet each preferably include an arm that pivots outwardly and locks to create a wedge between the side walls against rearward movement of the pallet. Each arm is angled rearwardly of the pallet at an acute angle, namely the arm forms a rearward facing acute angle relative to a longitudinal direction of the pallet so to wedge the pallet between the side walls of the container.

The arm also pivots through an arc between an unlocked position and a locked position and outward extension of the arm is preferably fixed at any point along the arc to form an acute angle. Fixing of the pivoting action can be achieved by tightening, or restraining, the arm against a locking mechanism housing which houses the arm.

The arm is preferably also adjustable in a longitudinal direction of the pallet, the longitudinal direction extending between the leading and rear ends of the pallet. Longitudinal adjustability is achieved by moving a pivot point of the arm along a longitudinal slot by way of a threaded shaft extending through the pivot point of the arm wherein rotation of the shaft tightens the arm against the housing. The threaded shaft is accessible from either the rear end or the leading end of the pallet so that an operator can manually rotate the shaft.

Preferably, the locking mechanisms are provided at or near the corners of the pallets between the rear end and sides.

In accordance with the present invention there is further provided a method for loading a mobile pallet into a container including:

- rolling a pallet chassis having a leading end, a rear end and opposite sides, into a container;
- extending at least one locking mechanism outwardly from a side of the pallet; and
- fixing the extension of the locking mechanism so that the mechanism locates against an adjacent inner side wall of the container and creates a wedge between the pallet and the side wall thereby locking the pallet in the container against rearward movement.

The method in one embodiment includes outwardly pivoting locking arms of the locking mechanisms to locate within recesses in the inner side walls of the container.

BRIEF DESCRIPTION OF THE DRAWINGS

Embodiments, incorporating all aspects of the invention, will now be described by way of example only with reference to the accompanying drawings in which.

DETAILED DESCRIPTION OF PREFERRED EMBODIMENT

Figure 1:
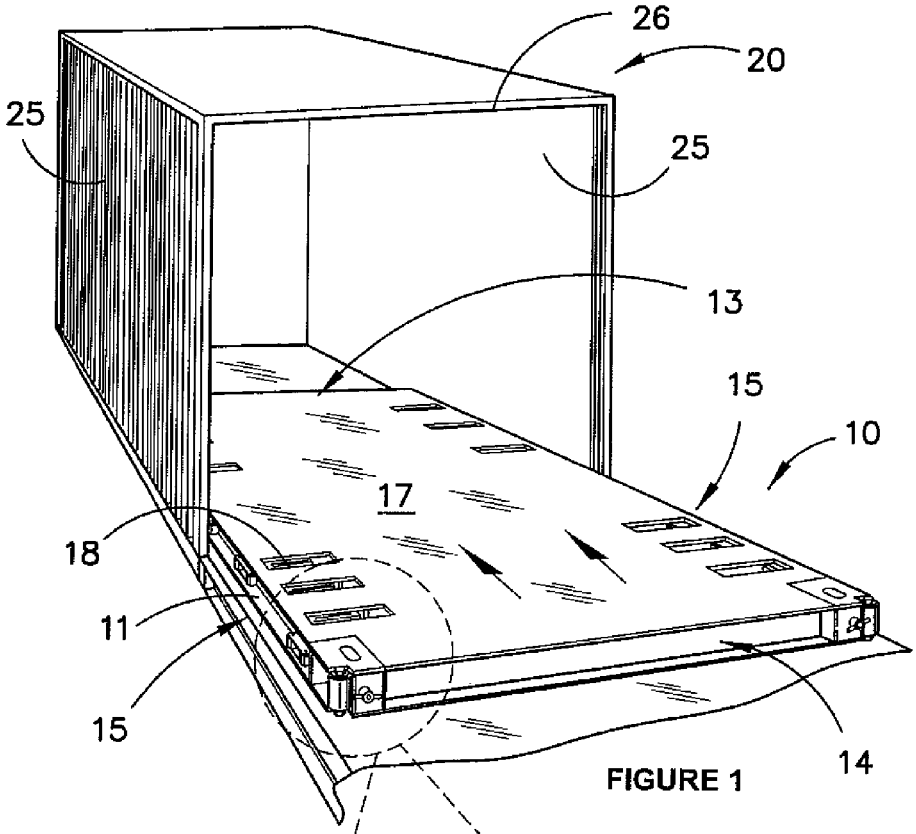
FIG. 1 is a perspective view of a mobile pallet in accordance with the present invention, being loaded into a container.

The mobile pallet described herein and illustrated in the drawings is of the type having its own wheel base for rolling the pallet into and out of containers. The containers with which the mobile pallet may be used are any type of freight container and include movable containers such as shipping containers that can be stacked one upon the other, or air freight and rail freight containers that are loaded onto aircrafts or trains. Alternatively, the containers may be fixed to a motorised vehicle such as a semi-trailer where the container may itself have its own wheel base and is towed by a prime mover.

The mobile pallet herein has the advantage of being lockable against lateral or longitudinal movement inside the container in an X-Y direction regardless of variations in container sizes. The mobile pallet is versatile, adjustable and effectively restrains movement of the pallet inside a container while being easily operated by users.

FIG. 1 illustrates a pallet 10, being loaded into a container 20. Pallet 10 includes a chassis 11 that is defined by a leading end 13 of the pallet, which is the end that first enters the container 20, a rear end 14 of the pallet opposite the leading end 13, and opposite sides 15 of the pallet located between the leading end 13 and rear end 14.

The chassis is rectangular in shape. The rectangular proportions may change so that a shorter pallet may appear square. In general however, the standard dimensions of the pallet will differ for different applications and correspond to standard dimensions of containers whether they are shipping containers, rail freight container, truck trailers or the like. The pallet dimensions may also be of lengths that are divisible of these container sizes so that multiple pallets may be used within a container. Some examples of standard container sizes include (but are not limited to) 10, 20, 30 and 53 foot length containers.

Lying on top of chassis 11 is a support floor 17 for supporting goods to be transported. Mounted inside the chassis perimeter and in communication with the ground are a series of roller wheels 18 on which the mobile pallet 10 is supported and moved. In the embodiment of the pallet illustrated in the drawings there are a total of twelve roller wheels 18 grouped in sets of three with each group located close to the sides 15 of the pallet towards either the leading end or rear end 13, 14.

The pallet chassis 11 on sides 15 is provided with pairs of roller guides 19 spaced along the side edges 16 which function to assist in guiding the pallet into a container without damage to the pallet or the container walls.

In the embodiment illustrated in the drawings pallet 10 comprises two locking mechanisms 30 located on opposite sides 15 of the pallet, or sufficiently near the sides so that the mechanism can extend outwardly of the sides 15 of the pallet, for example by being mounted at the rear end but extending outwardly of sides 15. In the embodiment illustrated, the locking mechanisms 30 are locking units 31 that are mounted at the rear corners of the pallet between the rear end 14 and each side 15.

The locking mechanisms 30 function together to, when activated, effectively wedge the pallet 10 inside container 20 thereby restraining the pallet against any lateral or longitudinal movement inside the container without the need for any other restraining means or locking mechanisms. A wedging effect is achieved by way of an outwardly extending locking member on either side of the pallet bearing against the container side walls in a manner that, should the pallet move to escape the container, would increase the wedging effect thereby restraining the pallet even further.

The pallets described herein in detail are shown having a locking mechanism 30 on both sides of the pallet, however it is understood that a locking, wedging effect of the pallet in a container can be achieved with only one locking mechanism mounted on only one side of the pallet. In such an embodiment the one locking mechanism at one of the rear corners would extend, and bear, against the adjacent inner wall of the container and create a wedge with that wall. This is sufficient to immobilise the pallet during movement in a forward-rearward direction inside the container because even though the opposing side of the pallet that does not have a locking mechanism is unrestrained, at worst the leading end 13 of the pallet will shift laterally until it bears against a container side wall. At best one side of the pallet can be placed directly against a side wall of the container with the locking mechanism on the other side of the pallet extended to wedge against the opposite container wall. In all circumstances, the pallet will remain locked in the container and will not roll out.

Figure 2:
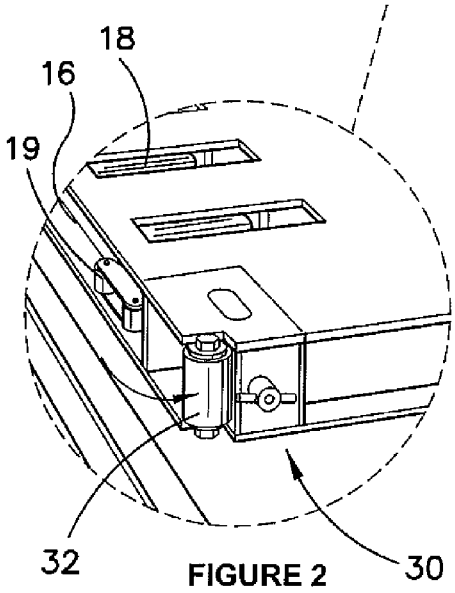
FIG. 2 is an enlarged view of a rear corner of the mobile pallet in FIG. 1 showing a locking mechanism according to a first embodiment of the invention in an unlocked condition.
Figure 3:
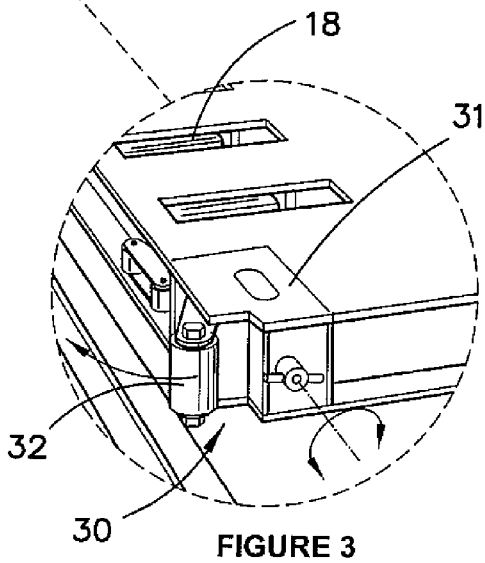
FIG. 3 is a view similar to FIG. 2 but showing the locking mechanism in a locked condition.

FIGS. 2 and 3 illustrate an enlarged view of a first embodiment of one of the locking mechanisms 30 in an unlocked condition and a locked condition, respectively. Pallet 10 is typically loaded into a container 20 with locking mechanisms 30 in an unlocked condition to ensure proper placement of the pallet 10 inside container 20. In the unlocked condition, locking mechanism 30 sits within the outer perimeter of the pallet 10 so as to not obstruct movement of the pallet. In the locked condition, an extendable member of the locking mechanism 30, namely a pivoting locking arm 32, swings outwardly to engage a corresponding recess in a side wall 25 of the container 20.

Figure 4:
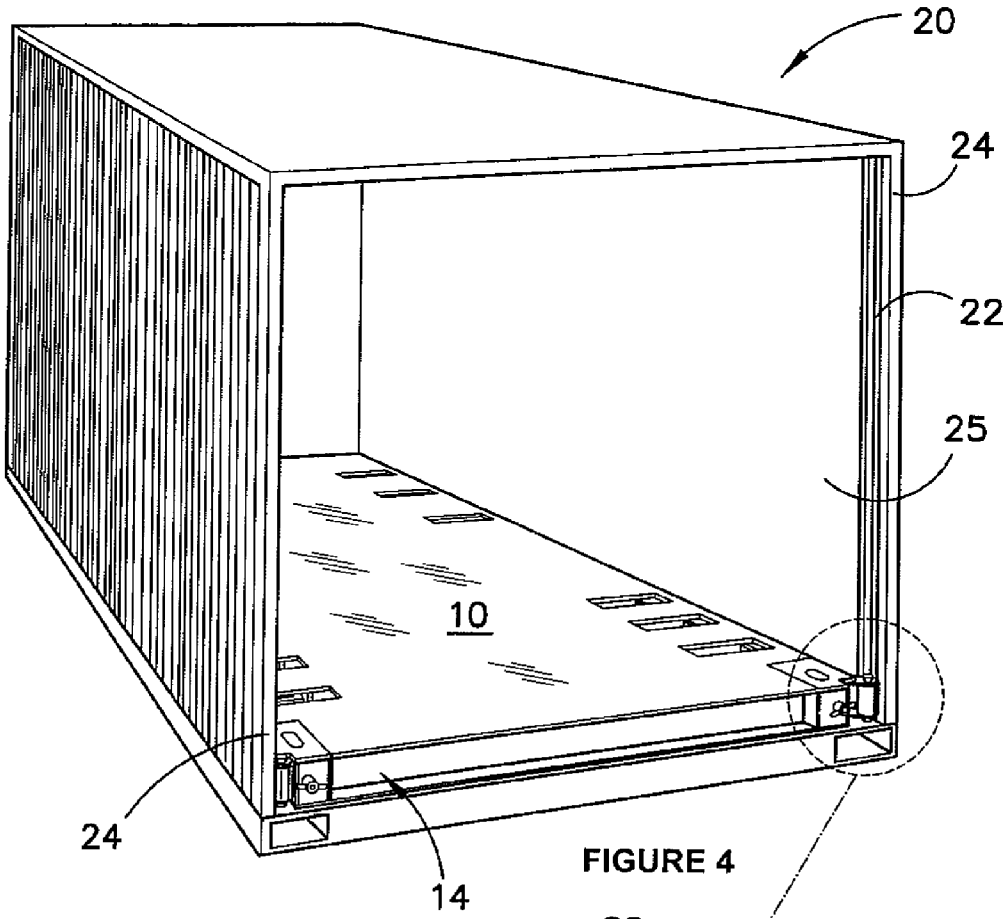
FIG. 4 is a perspective view illustrating the mobile pallet with the locking mechanism of the first embodiment loaded into a container.
Figure 5:
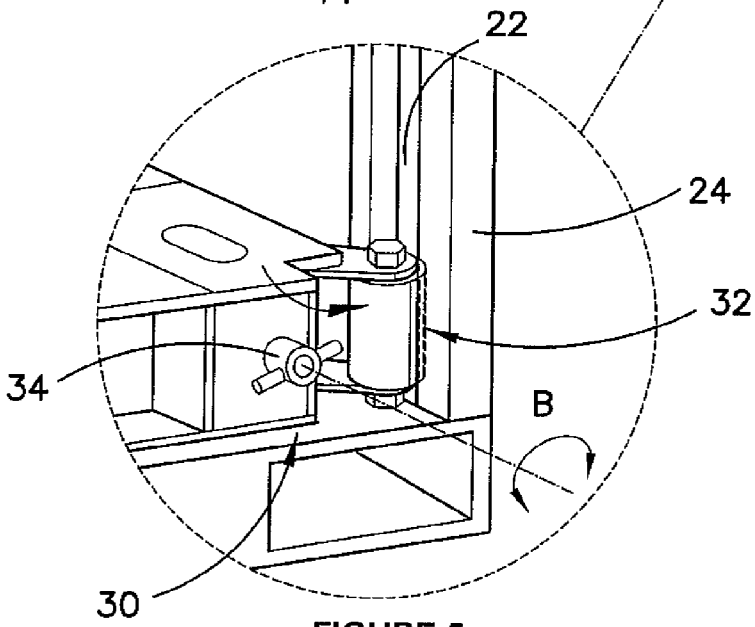
FIG. 5 is an enlarged view of a rear corner of the pallet illustrated in FIG. 4 showing the locking mechanism locked against a container wall.

Once a pallet is loaded into the container 20 through container opening 26, as illustrated in FIG. 4, the locking mechanism 30 is brought into the locked condition by swinging, or pivoting, the locking arm 32 from its stowed state against the side of the pallet to a locked condition where arm 32 extends beyond the outer perimeter of the pallet as illustrated in the enlarged views of FIGS. 3 and 5, whereby the arm is able to locate within a recess 22 in a container side wall 25 adjacent the locking mechanism 30.

In the embodiment illustrated arm 32 is manually pivoted between the unlocked condition and locked condition by turning handle 34, which extends through the rear end 14 of the pallet and is easily accessible to the person or persons loading the pallet.

Figure 6:
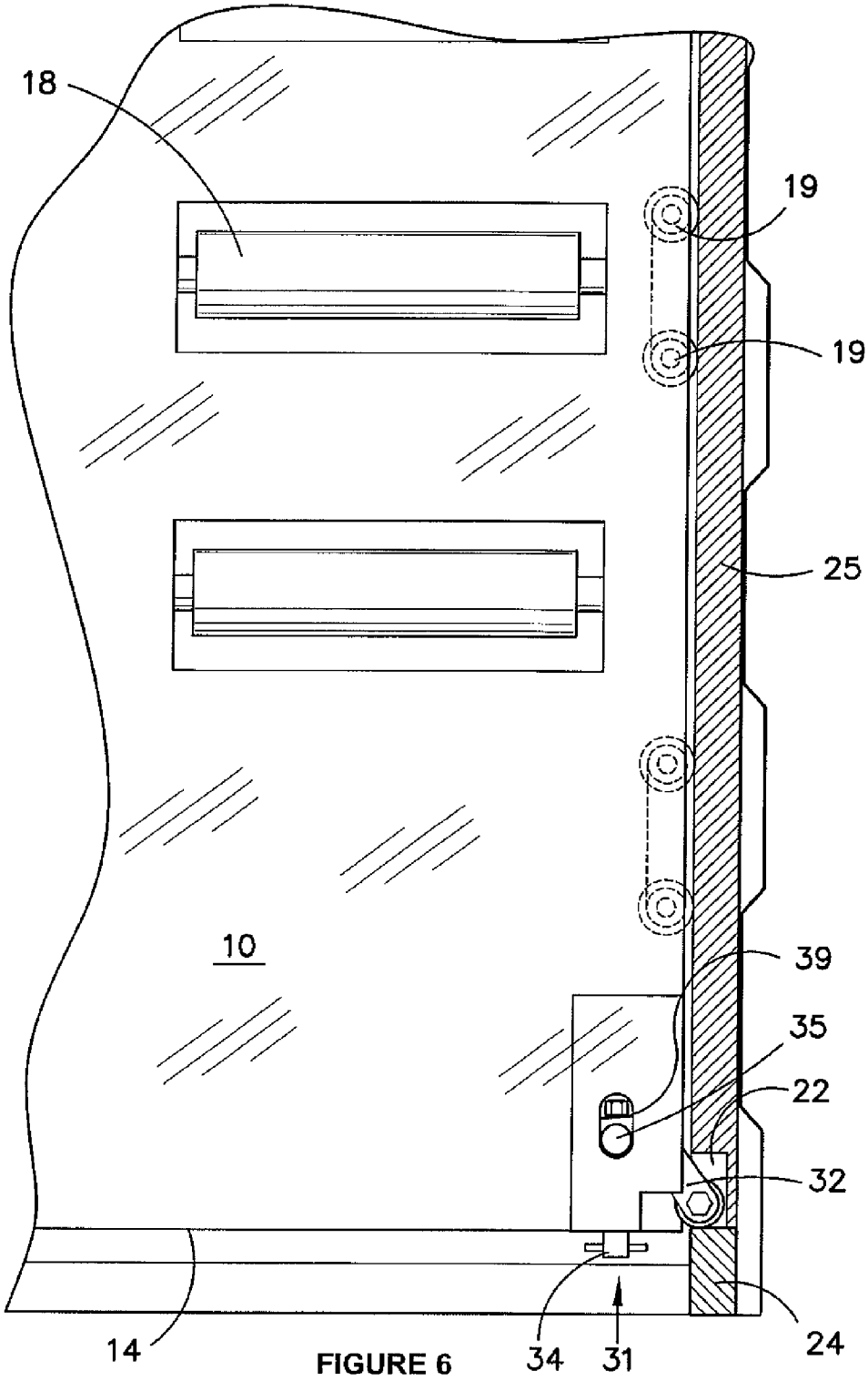
FIG. 6 is a partial plan view of the mobile pallet of FIG. 4 loaded and locked in the container.

The plan view of FIG. 6 illustrates more clearly arm 32 pivoted outwardly of pallet 10 to locate in recess 22 of container 20. Recess 22 of container 20 is a standard recess found in freight container walls along with a series of other recesses (not shown in the drawings) normally located between support posts in the walls. Recess 22 is selected in particular to receive locking arm 32 because it is located adjacent one of the four corner posts 24 of container 20 which are the strongest and most rigid posts in the container structure as these posts support not only the container frame and walls but also the weight of other loaded containers that may be stacked above.

Accordingly, pallet 10 can be confidently restrained inside the container by wedging opposing locking mechanisms 30 in recesses 22 without the risk of post 24 buckling or failing which could result in the escape of pallet 10 from the container or collapse of the container structure.

Figure 8:
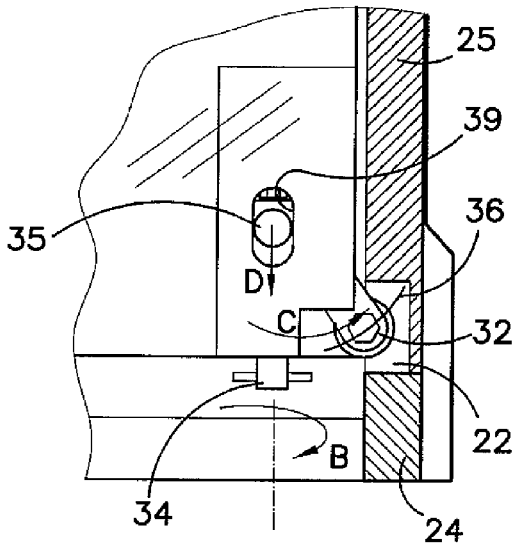
FIG. 8 is a second step in the sequence of views following FIG. 7 illustrating the locking mechanism pivoting outwardly towards a recess in a container.

Locking arm 32 swings about a pivot 35 and in pivoting outwardly from the unlocked condition to a locked condition the arm 32 follows through an arc 36. Arc 36 is illustrated in FIG. 8 and ranges between 0° to less than 90°.

Figure 9:
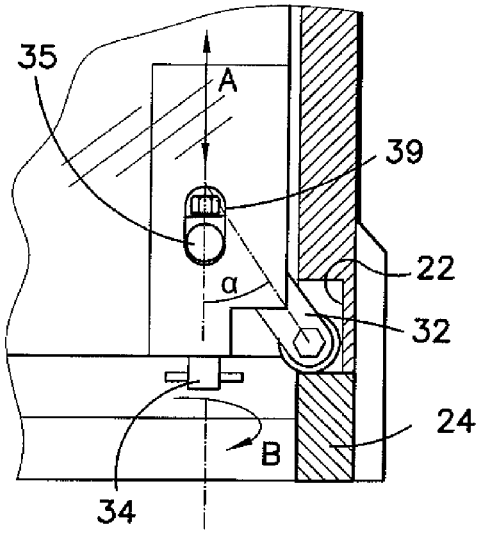
FIG. 9 is a third step in the sequence following FIG. 8 illustrating the locking mechanism engaging a container side wall.

In its outwardly extended position arm 32 is angled rearwardly of the pallet relative to a longitudinal direction of the pallet as illustrated by arrow A in FIG. 9. In other words, arm 32, when extended, forms a rearward facing acute angle relative to the longitudinal direction (arrow A) of the pallet. Arm 32 therefore approaches recess 22 at an angle, which not only allows for fine adjustment but also creates an increasing wedge in recess 22 against post 24 the more arm 32 extends outwardly.

When combined with the same, but opposite, outward extension of the opposing arm on the other side of the pallet, the result is a wedging of the pallet 10 against side walls 25 of the container 20 where the side wall 25 and corner posts 24 of the container counteract and maintain the force of the strong wedge applied by the pallet. Pallet 10 is therefore securely restrained in container 20 by locking mechanism 30 acting to wedge and lock the pallet against the side walls of the container.

The above scenario describes locking mechanism 30 acting to wedge the pallet in a container by locating locking arm 32 within a recess 22 in a container side wall 25. While it is preferred for the sake of pallet stability to locate arm 32 within a recess in the container wall, it is understood that opposing arms 32 may instead bear against a flat (or corrugated) container wall and not necessarily within a recess 22. This may actually be the case with some designs of containers, such as rail containers, where the side walls near the container doors may be devoid of recesses. A wedging effect would nevertheless be created by acutely angled arm 32 and maintained by the wedging force caused by opposing angled arms 32. Further means, such as frictional resistance between the arms and container wall for example by lining the ends of the arms with rubber, could assist in maintaining the wedging effect.

Locking arm 32 is also movable in the longitudinal direction (Arrow A in FIG. 9), of pallet 10 which allows the arm 32 to be correctly positioned by the operator longitudinally within recess 22 and to also restrain arm 32, or fix it, in the extended position. Longitudinal movement of locking arm 32 is effected by the pivot 35 of each arm 32 being reciprocally movable within a slot 39 in an upper plate 41 of locking unit 31.

Arm 32 can be fixed at any point along the arc 36 depending on how far from the recess 22 the side 15 of the pallet 10 is located. The maximum possible length of the arc described by the arm 32 will depend on the position of pivot 35 within slot 39. The further away pivot 35 is from rear end 14, the greater will be the length of arc described because arm 32 has greater freedom to pivot. This is because, as explained further below, internal walls limit the rotation of arm 32.

The gap 38 between the sides 15 of the pallet and the closest side walls 25 of the container 20 may vary from side to side as the pallet may not necessarily be loaded centrally in the container. Locking mechanisms 30 compensate for gap variations because each of the locking arms 32 are independently extendable where one arm may extend further out than the arm of the other locking mechanism. The range of sideways, or lateral, extension achievable by each locking arm is sufficient to allow the locking mechanism on one side to extend out and wedge against the adjacent container side wall if the pallet has been positioned directly abutting against the opposite side wall. Given the relative width of containers to pallets, such a range of movement could be from 0 mm to 100 mm.

Figure 7:
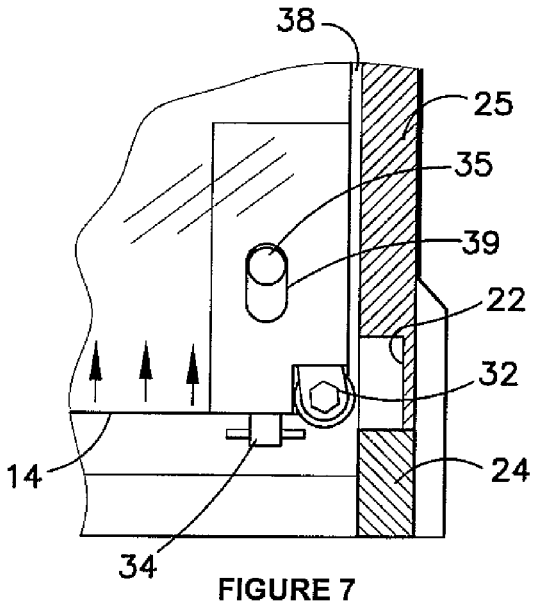
FIG. 7 is a first step in a sequence of enlarged plan views illustrating the mobile pallet of FIG. 4 being loaded into a container.

FIGS. 7, 8 and 9 illustrate in a sequence of three steps the loading of pallet 10 into a container 20 and the activation of locking mechanism 30 to restrain the pallet within the container.

In FIG. 7, pallet 10 is moved into the container 20 in the direction of the arrows shown. Arm 32 is stowed in the unlocked condition and pivot 35 is located in a forward-most end of slot 39.

FIG. 8 illustrates the locking arm being moved into a locked condition in the direction of arrow C. An operator turns handle 34 in the direction of arrow B which causes pivot 35 to move rearwardly in slot 39 in the direction of arrow D towards a rearmost position whereby the outward swing of the arm can be fixed at the desired extended angle. Meanwhile, the operator manually swings arm 32 outward from its stowed condition into recess 22.

FIG. 9 illustrates the continued rotation of handle 34 in the direction of arrow B to bring pivot 35 at the rearmost position in slot 39 which will cause arm 32 to be fixed at the angle at which the operator has extended the arm, which is indicated by angle $\alpha$ shown in FIG. 9. Angle $\alpha$ is an acute angle, and namely is less than 90°.

By arm 32 being extended at an acute angle $\alpha$, and not extending perpendicularly at a 90° angle against the side wall of the container, a wedging effect can be created to restrain the pallet and eliminate the risk of pallet 10 rolling out of the container when the doors of a container (doors are not shown) are intentionally or inadvertently opened. Any movement of the pallet 10 to escape through the container opening 26 is prevented by arms 32. The weight of the pallet in the direction of container opening 26 creates an even greater wedging effect of the pallet in the container.

Figure 10:
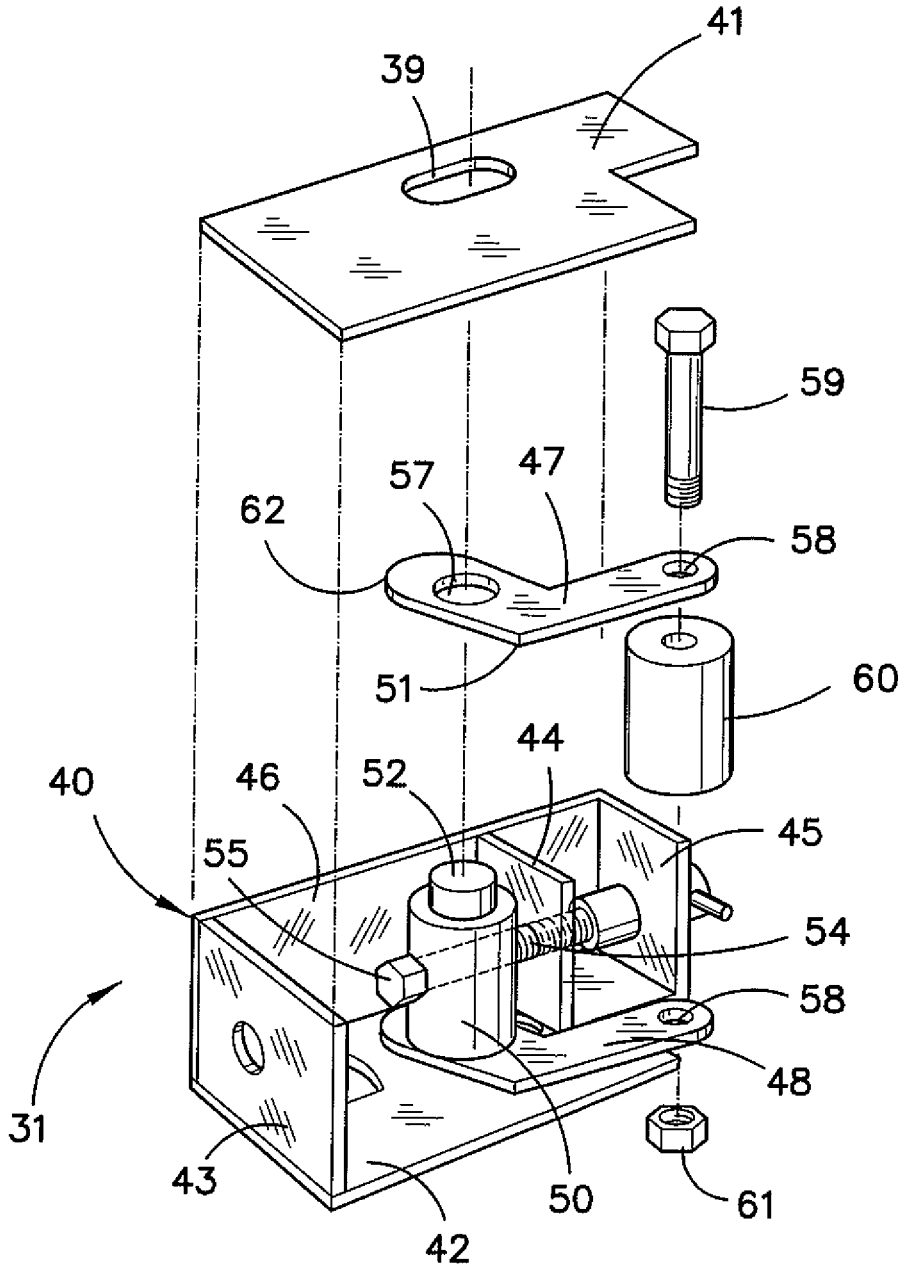
FIG. 10 is an exploded isometric view of the locking mechanism of the first embodiment.
Figure 11:
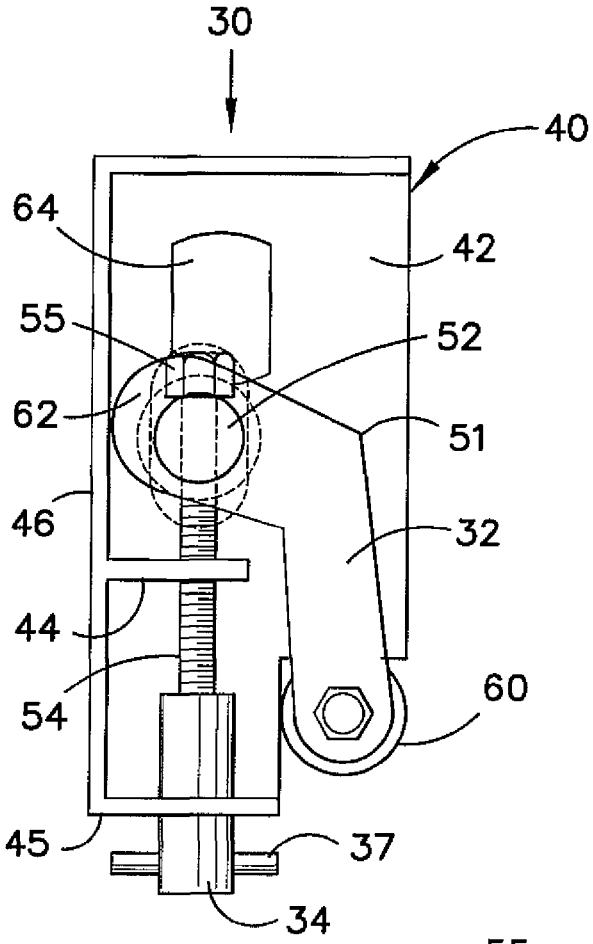
FIG. 11 is an open plan view of the locking mechanism illustrated in FIG. 10 shown in an unlocked condition.
Figure 12:
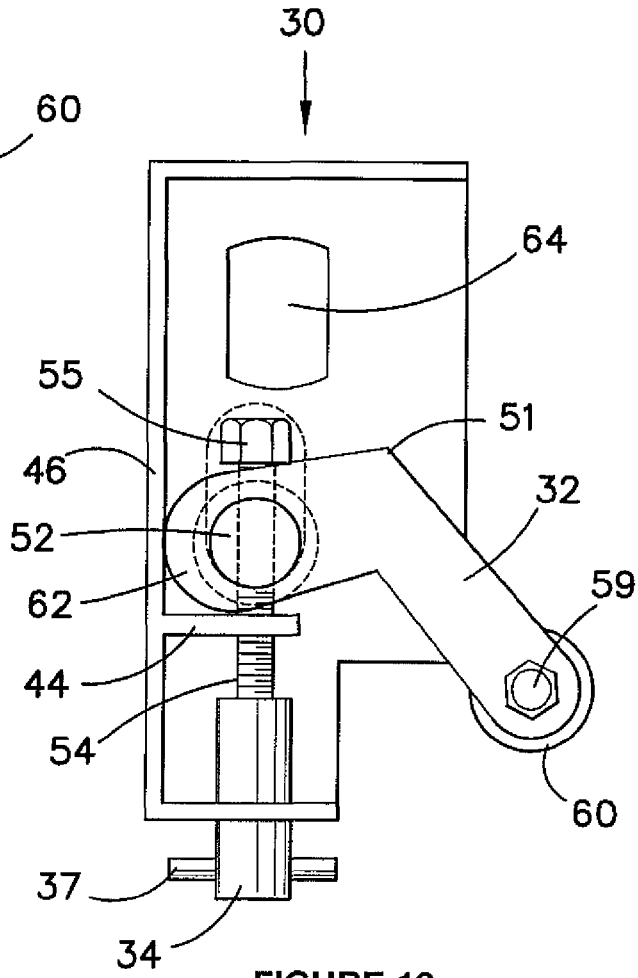
FIG. 12 is a view similar to FIG. 11 but showing the locking mechanism in a locked condition.

FIGS. 10, 11 and 12 illustrate the components of locking unit 31 comprising locking mechanism 30. Each locking unit is located at the rear corners of pallet 10 and comprise a housing 40 typically made of stainless steel plates or angles welded together. The whole locking unit 31 is itself attached to the sides of chassis 11 by any suitable conventional means such as welding or bolting the unit to the chassis 11. Housing 40 includes upper plate 41, lower plate 42 and walls in between the upper and lower plates including a front wall 43, mid wall 44, rear wall 45 and a side wall 46.

Locking arm 32 comprises an upper arm plate 47 and a lower arm plate 48 separated by a cylindrical rotatable spacer 50. Upper and lower plates 47, 48, and hence locking arm 32, are bent at an elbow 51 so that arm 32 forms a roughly open L-shape that conveniently pivots between an unlocked and locked condition as well as reciprocally moves in the longitudinal direction of arrow A of the pallet while keeping the locking unit as compact as possible and neatly stored within the perimeter of the pallet. FIGS. 11 and 12 illustrate in plan sectional view the bent nature of locking arm 32 in a locked and unlocked condition.

Handle 34 includes a cross-pin 37 which an operator can grasp in order to turn the handle. Handle 34 extends through a hole in rear wall 45 of housing 40 and has an internally threaded bore (not shown) at its opposite end to cross pin 37 to receive a threaded shaft 54. Threaded shaft 54 extends from inside handle 34 through a hole in mid wall 44 of housing 40 and through cylindrical rotating spacer 50 of arm 32. The end of threaded shaft 54 that extends through spacer 50 is capped with a nut 55 that may or may not be fixed to spacer 50. Nut 55 ensures that spacer 50 remains in position at the end of threaded shaft 54 and to thereby move with shaft 54.

When an operator turns handle 34, shaft 54 causes locking arm 32 (through spacer 50) to move longitudinally along slot 39 as shaft 54 retracts into or extends out from the internally threaded bore of handle 34.

As best seen in FIG. 10, the opposite ends of cylindrical spacer 50 are provided with circular bosses 52 which locate in slots 39 provided in both upper and lower plates 41, 42 to provide the reciprocal longitudinal movement of arms 32. In this way spacer 50 is retained between upper and lower plates 41, 42 and allowed only to rotate and to move along slots 39.

Upper and lower arm plates 47, 48 also include boss holes for each arm to locate over a boss 52 at either end of the spacer 50 and to pivot thereon. Accordingly, bosses 52 provide the pivot point, or pivot 35, for arm 32.

At the opposite external ends of arm plates 47, 48 is an aperture 58 that receives a bolt 59 that extends through the spaced upper and lower plates and supports between the plates a roller 60. A nut 61 maintains the plate/roller assembly on bolt 59. Roller 60 rotates on bolt 59 to assist in locating arm 32 in recess 22. Roller 60 may be made of a metal, such as stainless steel, and may in some circumstances be padded with, for example, a rubber sheath extending around the curved surface of the roller to dampen any impact from movement between the locking mechanism 30 and container walls.

The internal end of locking arm 30 that sits inside locking unit 31 and from which arm 32 is pivoted, has an enlarged rounded shoulder 62. When an operator pivots arm 32 outwardly to locate the arm in a container recess 22 and then fixes the arm at the desired extension, shoulder 62, by way of threaded shaft 54, is brought to sit tight against the angle created by mid wall 44 and side wall 46 as illustrated in FIG. 12. Tightening handle 34 with arm 32 in the rearmost position as illustrated in FIG. 12 ensures a tightening force is applied between nut 55, mid wall 44 and side wall 46 to prevent any substantial pivoting movement of arm 32 once located in recess 22. In this manner arm 32 is fixed in the outwardly extended position, which when acting with the locking mechanism provided on the opposite side of the pallet, restrains the pallet from any movement inside the container 20. Mid wall 44 therefore limits the extent of rotation of arm 32.

FIGS. 10, 11 and 12 also show an enlarged window 64 in lower plate 42 of housing 40. Window 64 may be used as an anchor point to restrain the pallet in an external locking system when transported on a vehicle after unloading from a container. Most commonly this occurs when the pallet with goods is loaded on to a tray of a truck, or similar, where the truck has at its corners a locking system comprising locking rods for anchoring a pallet to the truck tray. The truck's locking rods would extend through windows 64 in locking mechanisms 30 and rotate so that a foot provided on the ends of the rods can be anchored against lower plate 42 to fix the pallet 10 to the truck.

Figure 14:
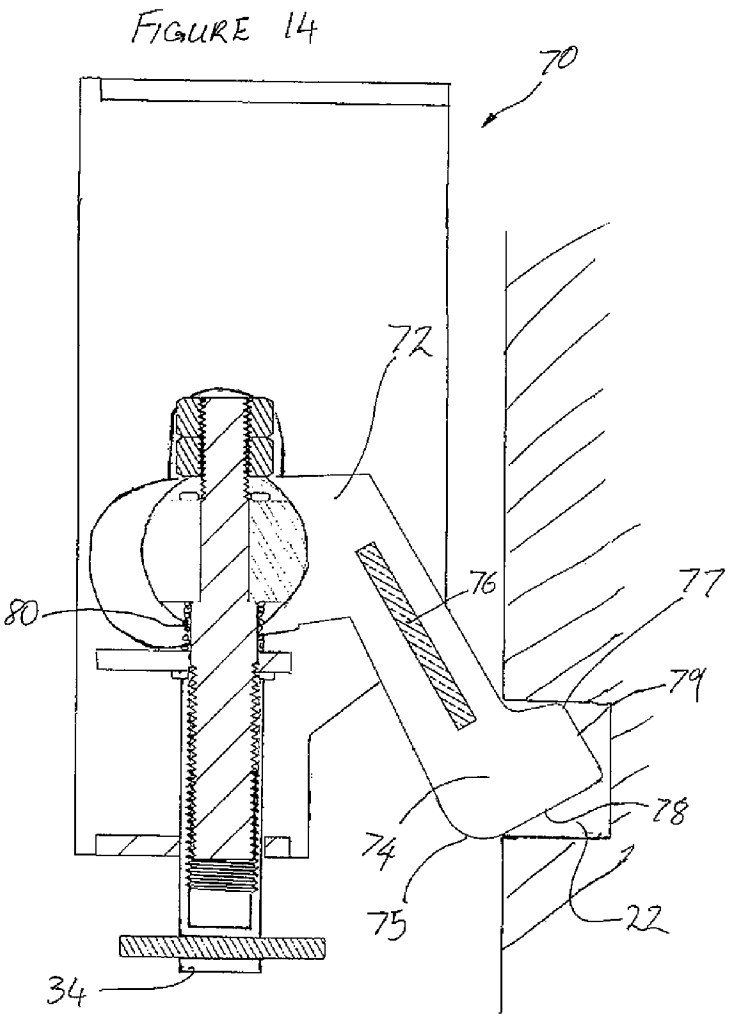
FIG. 14 is a view similar to FIG. 13 but showing the locking mechanism in a locked condition.
Figure 13:
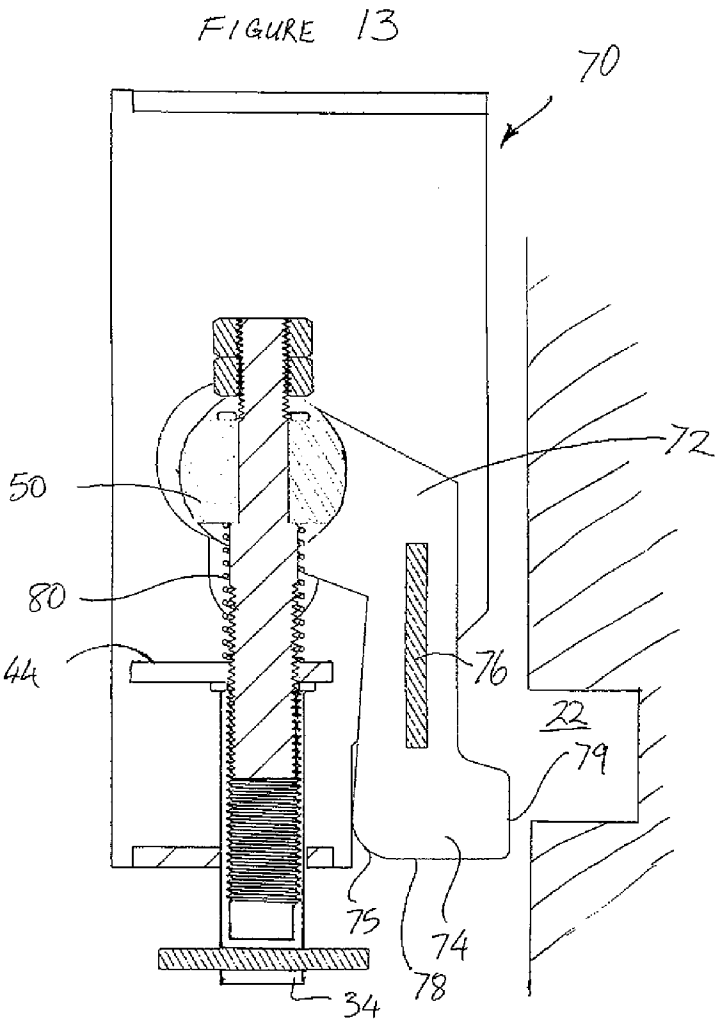
FIG. 13 is an open plan view of a second embodiment of the locking mechanism in accordance with the invention of a pallet, shown in an unlocked condition.
Figure 15:
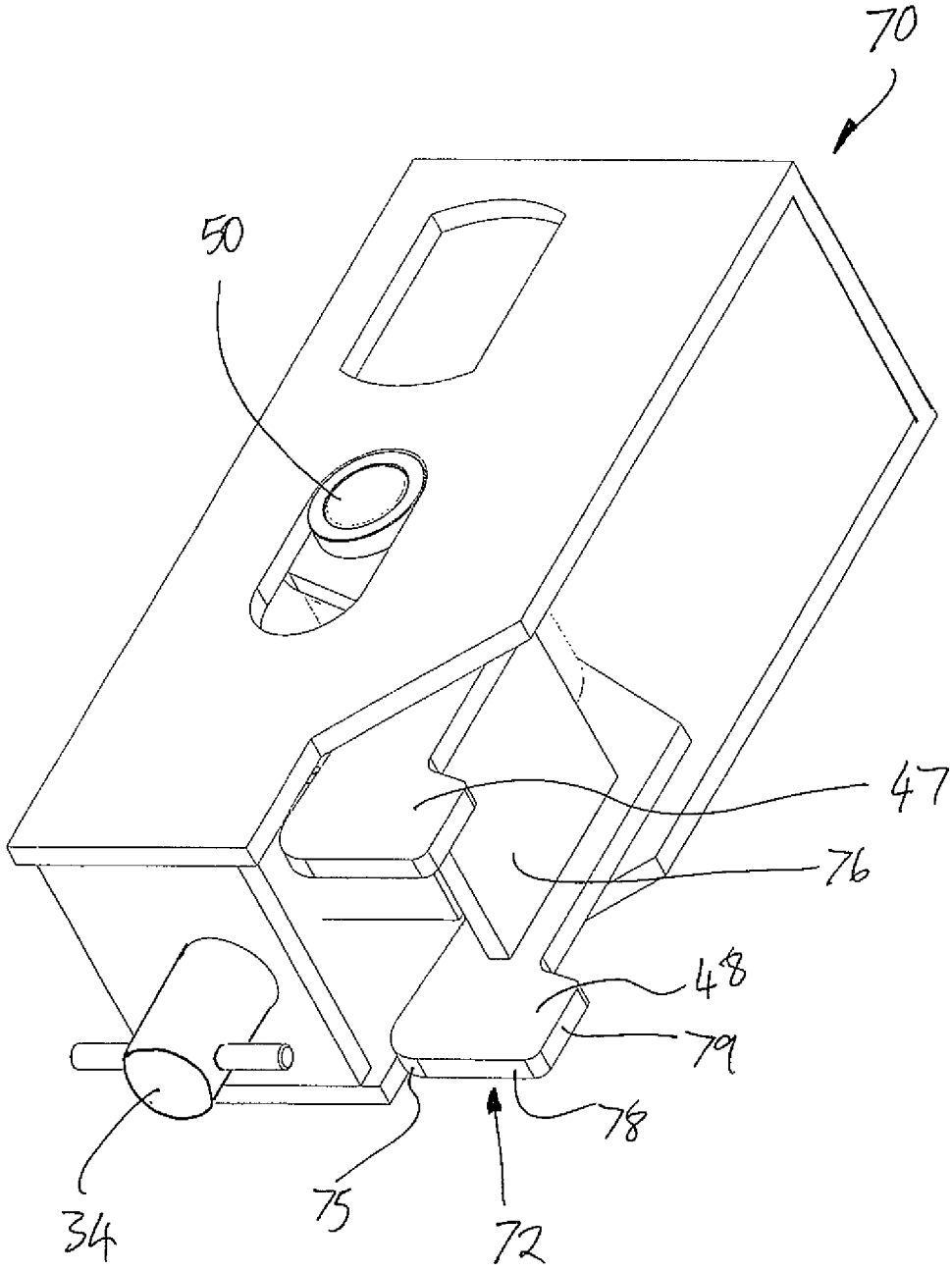
FIG. 15 is an isometric view of the second embodiment of the locking mechanism.

FIGS. 13, 14 and 15 illustrate a second embodiment of a locking mechanism 70 on a pallet 10. The parts of the second embodiment of the locking mechanism 70 that are the same as the first embodiment locking mechanism 30 share the same references numbers. Locking mechanism 70 differs from the first embodiment locking mechanism 30 in that there is no roller at the end of locking arm 72. Instead locking arm 72 bends to form a foot 74. Locking arm 72 is also formed from spaced upper and lower arm plates 47, 48 and includes a cross plate 76 to give the locking arm 72 structural integrity in the absence of a roller.

Foot 74 has a curved heel 75 that leads into a flat base 78 terminating at an end wall 79 of the foot. When extended at the acute angle required to wedge the pallet in a container, foot 74 locates inside a recess 22 with the load of the wedged pallet being carried by rounded heel 75 and a top corner 77 of end wall 79. Because heel 75 is rounded the foot 74 can extend into recess 22 to varying degrees with a portion of heel 75 satisfactorily bearing some of the load of the wedged pallet.

The second embodiment of the locking mechanism 70 also includes a compression spring 80 located between mid wall 44 and pivoting spacer 50. The purpose of spring 80 is to assist in tightening and locking arm 72 at the optimum position against the container wall or recess, as well as absorbing vibrational forces and other movements during transit.

While in the preferred embodiment illustrated in the drawings the locking mechanisms 30, 70 are shown as being located at the rear corners of pallet 10 it is just as feasible that the locking mechanisms be provided at the front corners of pallet 10 to locate in similar recesses found at the back wall of a container 20 and against the corner posts at the back wall. Alternatively, some containers are provided with doors at both ends of the container and it is foreseeable that a mobile pallet of the kind described herein could be modified to include locking mechanisms 30, 70 at each of the four corners of the pallet where, although only opposing mechanisms are required, the option is available to activate all four locking mechanisms.

It is also feasible to provide locking mechanisms 30, 70 along the sides 15 of the pallet away from any corner and located midway or partway down the side 15 of the pallet. In such a case it would be preferred that the position of the locking mechanism 30, 70 coincides with a corresponding recess in the container side walls 25 so that the pallet can be adequately restrained between the container walls in a lateral direction and wedged against movement in the longitudinal direction.

However, as discussed above, the locking mechanisms 30, 70 need not locate in a container wall recess but may simply locate against the container wall. In still another alternative the locking mechanisms may locate against an adjacent pallet where side room for another pallet is provided.

Where the locking mechanism locates within a recess in the container wall, not only is rearward movement prevented by the wedging force created, but forward movement is also prevented because the end of the arm (or foot) is sized to fill the recess and thereby anchors any pallet movement in a longitudinal direction.

An advantage of the mobile pallet is that in long freight containers that would normally load two pallets in tandem, a single pallet of the kind described herein can be loaded on its own within a long freight container without requiring a tandem pallet against which to be restrained. This is because the present mobile pallet can adequately be self restrained by way of the wedging action of the locking mechanisms.

Another advantage is that a mobile pallet equipped with one or more of the locking mechanisms does not need to rely on being immobilised by locking against, or bearing the pallet load against, the container doors, as is the case with some systems.

The operation of the locking mechanism described herein is largely manually operated where manually rotating the handle 34 loosens or tightens the fixing force on arm 32 to either allow or prevent arm 32 from pivoting. Pivoting of arm 32 is then manually carried out by an operator. However, it is understood that pivoting of the arm may be automated.

For example, the arm may be biased in an outwardly direction by way of a torsion spring mounted around pivot 35 or a helical spring mounted between the arm 32 and housing 40. In this situation the pallet would be loaded into the container with arms 32 on opposite sides of the pallet already extended. As the arms 32 are moved past corner posts 24 at the container opening 26 the posts 24 would push the biased arms inwardly against the biasing force. The arms would move back out once clear of the posts to locate into recesses 22. The handle 34 would then be used during unloading to pull the arms back toward the pallet in order to unload the pallet from the container. This could be achieved, for example, by way of a return mechanism such as a return arm acting in the opposite direction to the biased spring.

The above is just one example of a mechanical equivalent that could be implemented to partly or fully automate the process of loading and unloading, and locking and unlocking, the pallet from the container. Any number of mechanical variations are possible which could achieve the same purpose of outwardly extending the locking mechanism against the side walls or rear corners of a container to prevent lateral and longitudinal movement of a pallet inside a container.

It will be understood to persons skilled in the art of the invention that many modifications may be made without departing from the spirit and scope of the invention.

The invention claimed is:

1. A mobile pallet for loading into a container, the pallet comprising:

a pallet chassis defining a leading end, a rear end and opposite sides of the pallet;

wheels supporting the chassis for mobility;

at least one locking mechanism on one side of the pallet including an arm that pivots outwardly of the pallet to bear against an adjacent inner side wall of the container wherein, in extension, the arm is angled rearwardly of the pallet at an acute angle to create a wedge between the pallet and the side wall thereby locking the pallet in the container against rearward movement of the pallet;

wherein a pivot point of the arm is movable along a slot aligned in the longitudinal direction of the pallet; and wherein movement of the arm along the slot is caused by rotation of a threaded shaft that extends through the pivot point of the arm.

2. The mobile pallet claimed in claim 1, wherein the locking mechanism includes an outwardly extending member that locates against an adjacent side wall to wedge the pallet within the container.

3. The mobile pallet claimed in claim 1, wherein the mobile pallet comprises two locking mechanisms, one to each side of the pallet to create a wedge between the pallet and side walls of the container.

4. The mobile pallet claimed in claim 1, wherein the arm pivots through an arc and outward extension of the arm can be fixed at any point along the arc.

5. The mobile pallet claimed in claim 4, wherein the arm is restrained against a housing of the locking mechanism to prevent the arm from pivoting.

6. The mobile pallet claimed in claim 1, wherein the arm is adjustable in a longitudinal direction of the pallet.

7. The mobile pallet as claimed in claim 6, wherein the pivot point of the arm is securable along the slot aligned in the longitudinal direction of the pallet.

8. The mobile pallet claimed in claim 1, wherein tightening of the threaded shaft restrains the arm against a housing of the locking mechanism to prevent pivoting movement.

9. The mobile pallet claimed in claim 1, wherein a roller is provided at the end of the arm.

10. The mobile pallet claimed in claim 1, wherein an end of the arm is broadly shaped as a foot.

11. A method for loading a mobile pallet into a container including:

rolling a pallet chassis having a leading end, a rear end and opposite sides, into a container;

extending at least one locking mechanism outwardly from a side of the pallet by pivoting a locking arm of the locking mechanism such that the locking arm is angled rearwardly of the pallet at an acute angle; and fixing the extension of the locking arm thereby locating the mechanism against an adjacent inner side wall of the container and creating a wedge between the pallet and the inner side wall to lock the pallet in the container against rearward movement;

wherein a pivot point of the arm is movable along a slot aligned in the longitudinal direction of the pallet;

wherein movement of the arm along the slot is caused by rotation of a threaded shaft that extends through the pivot point of the arm.

12. The method claimed in claim 11 including outwardly pivoting a locking arm of the locking mechanism to locate within recesses in the inner side walls of the container.

13. The method claimed in claim 11 including extending two locking mechanisms outwardly, one from each side of the pallet.

* * * * *